US007426958B2

(12) United States Patent
Yu

(10) Patent No.: US 7,426,958 B2
(45) Date of Patent: Sep. 23, 2008

(54) HEADER FOR HEAT EXCHANGER

(75) Inventor: Wen Fei Yu, Ann Arbor, MI (US)

(73) Assignee: Visteon Global Technologies Inc., Dearborn, MI (US)

( * ) Notice: Subject to any disclaimer, the term of this patent is extended or adjusted under 35 U.S.C. 154(b) by 143 days.

(21) Appl. No.: 10/643,406

(22) Filed: Aug. 19, 2003

(65) Prior Publication Data

US 2005/0039900 A1 Feb. 24, 2005

(51) Int. Cl.
*F28F 9/02* (2006.01)

(52) U.S. Cl. ..... 165/173; 165/906

(58) Field of Classification Search ..... 165/151, 165/153, 173, 175, 906
See application file for complete search history.

(56) References Cited

U.S. PATENT DOCUMENTS

| | | | | |
|---|---|---|---|---|
| 1,730,470 | A * | 10/1929 | Modine | 165/151 |
| 1,893,521 | A * | 1/1933 | Modine | 165/151 |
| 3,689,972 | A | 9/1972 | Mosier et al. | |
| 4,615,385 | A | 10/1986 | Saperstein et al. | |
| 5,067,235 | A | 11/1991 | Kato et al. | |
| 5,152,339 | A | 10/1992 | Calleson | |
| 5,172,762 | A | 12/1992 | Shinmura et al. | |
| 5,289,873 | A * | 3/1994 | Ryan et al. | 165/153 |
| 5,743,122 | A | 4/1998 | Rhodes et al. | |
| 5,797,448 | A * | 8/1998 | Hughes et al. | 165/151 |
| 5,890,288 | A | 4/1999 | Rhodes et al. | |
| 5,901,443 | A | 5/1999 | Rhodes et al. | |
| 5,931,217 | A * | 8/1999 | Fernstrum | 165/44 |
| 5,931,223 | A | 8/1999 | Yu et al. | |
| 5,934,365 | A | 8/1999 | Rhodes et al. | |
| 6,119,769 | A | 9/2000 | Yu et al. | |
| 6,216,776 | B1 * | 4/2001 | Kobayashi et al. | 165/173 |
| 6,360,560 | B1 | 3/2002 | Whitlow et al. | |
| 6,540,016 | B1 | 4/2003 | Baldantoni | |
| 6,830,100 | B2 * | 12/2004 | Gowan et al. | 165/173 |
| 7,044,209 | B2 * | 5/2006 | Petersen | 165/173 |
| 2004/0050540 | A1 * | 3/2004 | Kato et al. | 165/153 |

FOREIGN PATENT DOCUMENTS

| | | |
|---|---|---|
| JP | 2003114094 | 4/2003 |

* cited by examiner

*Primary Examiner*—Leonard R Leo
(74) *Attorney, Agent, or Firm*—Brinks Hofer Gilson & Lione

(57) ABSTRACT

A header for a heat exchanger includes a substantially planar base portion and a pair of step portions. The step portions are angled from the plane of the base portion. The header is also provided with a plurality of substantially parallel slots spaced apart along the length of the header. Each slot has an elongate section extending across the width of the base portion and end sections extending from the elongate section into the step portions of the header.

14 Claims, 4 Drawing Sheets

HEADER FOR HEAT EXCHANGER

BACKGROUND

1. Technical Field

The present invention relates generally to heat exchangers, and more particularly relates to headers for heat exchangers.

2. Background Information

Typically, automotive vehicles are provided with an engine cooling system with a heat exchanger, such as a radiator. When the engine is running, heat is transferred from the engine to a coolant that flows through the engine, thereby cooling the engine. The coolant then flows from the engine to the heat exchanger through a series of conduits. At the heat exchanger, heat is transferred from the coolant to cooler air that flows over the outside of the heat exchanger. This process repeats itself in a continuous cycle.

A typical heat exchanger includes a series of tubes supported by two headers. One type of conventional header is a flat header. When these flat headers are joined to a respective tube, for example, by brazing, the joint between the header and the tube lies in a flat plane. These types of header/tube combinations are prone to failure because of the stress concentrations that occur along the header/tube joint. These stresses are typically attributable to the thermal loading (i.e., stresses induced by the rise and fall of the temperature of the heat exchanger components) on the header and tubes during the operation of the engine.

From the above, it is seen that there exists a need for an improved heat exchanger header that experiences less thermal loading.

BRIEF SUMMARY

In overcoming the above mention and other drawbacks, the present invention provides a heat exchanger header which when combined with a tube removes the highest stress concentrations in the header/tube joint.

In one embodiment, a header for a heat exchanger includes a substantially planar base portion and a pair of step portions. The step portions are angled from the plane of the base portion. The step portions are connected by either a straight or a curved section. The header is also provided with a plurality of substantially parallel slots spaced apart along the length of the header. Each slot has an elongate section extending across the width of the base portion and end sections extending from the elongate section into the step portions of the header.

Various embodiments of the header can have one or more of the following features. The end sections each can have terminal ends spaced apart from the plane of the base portion, defining a separation distance. Each slot can be provided with a tube inserted into the slot. In certain embodiments the tube is brazed to the respective slot. The juncture between each tube and the elongate section of a respective slot defines a transition line of deformation spaced apart from the highest stress concentrations occurring in the brazing joint at or near the location of the juncture between the terminal ends and the tube.

The foregoing discussion has been provided only by way of introduction. Nothing in this section should be taken as a limitation on the following claims, which define the scope of the invention.

BRIEF DESCRIPTION OF THE DRAWINGS

The accompanying drawings, incorporated in and forming a part of the specification, illustrate several aspects of the present invention and, together with the description, serve to explain the principles of the invention. The components in the figures are not necessarily to scale, emphasis instead being placed upon illustrating the principles of the invention. Moreover, in the figures, like reference numerals designate corresponding parts throughout the views. In the drawings.

DETAILED DESCRIPTION

Figure 1:
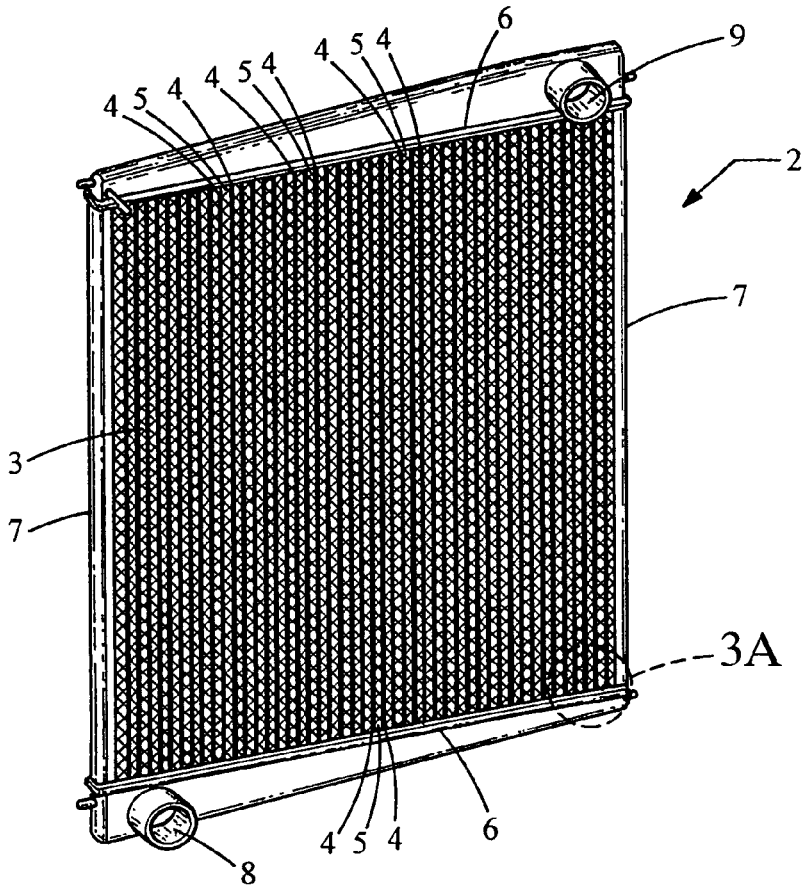
FIG. 1 depicts an automotive radiator.

FIG. 1 illustrates a typical automotive radiator 2 with a heat exchanger core or matrix 3. The core 3 includes a number of parallel coolant tubes 4 with heat exchanger fins 5 of concertina form positioned between and in contact with the tubes 4. The tubes 4 are mounted to a pair of headers 6. A pair of side walls 7 provide additional structural support to the core 3. When the radiator 2 is in use, coolant heated by the engine enters an inlet 8 and circulates through the tubes 4 as air moves through the fins 5. As such, heat in the tubes 4 is exchanged with the air passing through the fins. The cooler coolant exits the radiator 2 through an exit 9 and returns to the engine to repeat the engine cooling process.

Figure 2A:
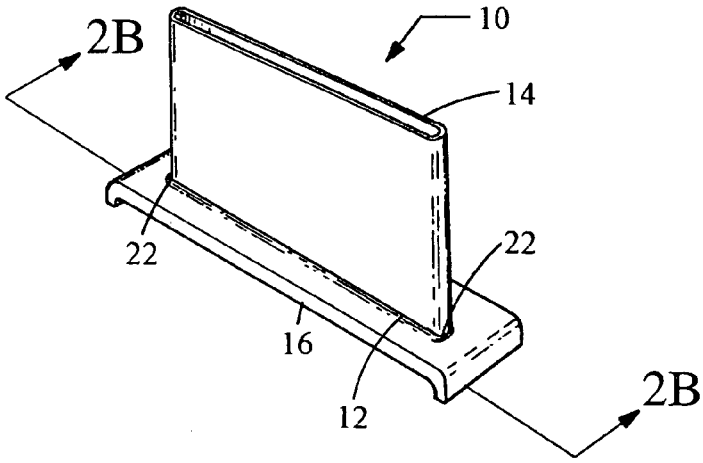
Fig. 2A Prior Art
FIG. 2A depicts a portion of a conventional heat exchanger header with a flat tube.

A heat exchanger in an automotive vehicle typical experiences a significant amount of thermal loading, since the heat exchanger is subjected to extreme temperature variations during its lifetime, thereby leading to a failure of the exchanger. For example, referring to FIG. 2A, in a conventional heat exchanger tube 10, failure, such as a crack, caused by thermal loading usually occurs on the tube at or near the intersection 12 between a flat tube 14 and a header 16, in particular, at the location 22 where the externally induced stress (or service stress) from the thermal loading overlaps with the highest stress concentrations of the joint between the header 16 and tube 14, as described below in greater detail.

Figure 2B:
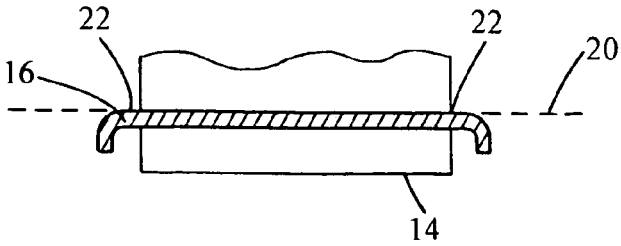
Fig. 2B Prior Art
FIG. 2B is a side view of the conventional header with a portion of the flat tube along the line 2B-2B of FIG. 2A.

Externally induced service stress typically occurs on the tube at or near the boundary between the tube 14 and the header 16. On one side of this boundary (i.e. the internal or coolant side), the tube 14 does not deform because of the restriction of the header 16. On the other side, however, the tube 14 deforms under thermal loading. For purposes of illustration, the intersection of the tube 14 and the header 16 define a plane, which in turn defines a "transition line of deformation" 20, as shown in FIG. 2B, when the tube/header combination is viewed along the line 2B-2B of FIG. 2A.

The tube 14 and header 16 are in many cases joined together by a suitable process, for example, by brazing. Thus, stresses occur along the brazing between the tube 14 and header 16. Note that stress concentration is a physical property related to the geometry of the tube-to-header joint configuration. The highest stress concentration generally occurs at or near the narrowest region of the tube 14 that intersects the header 16, namely, at the locations identified by the reference numerals 22. When the "transition line of deformation" 20 overlaps the "stress concentration" 22, as in the case of the tube/header combination of FIGS. 2A and 2B, the externally induced stress intensifies, leading typically to early failure of the heat exchanger.

Figure 3A:
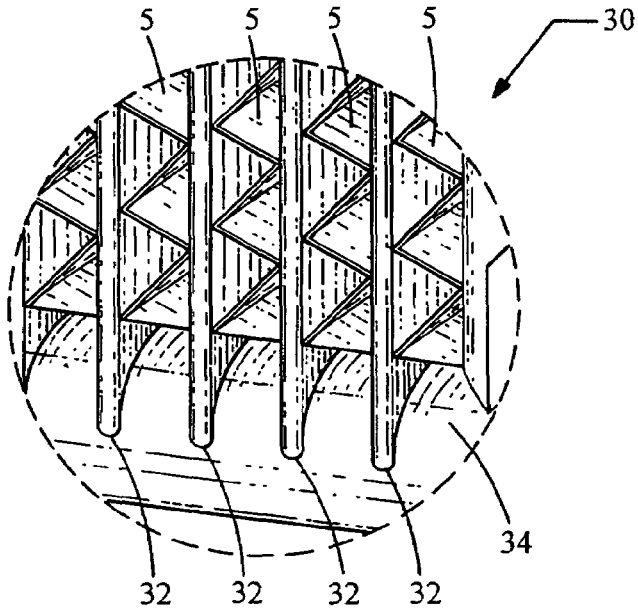
FIG. 3A depicts a portion of a heat exchanger header with several flat tubes in accordance with the invention.
Figure 3B:
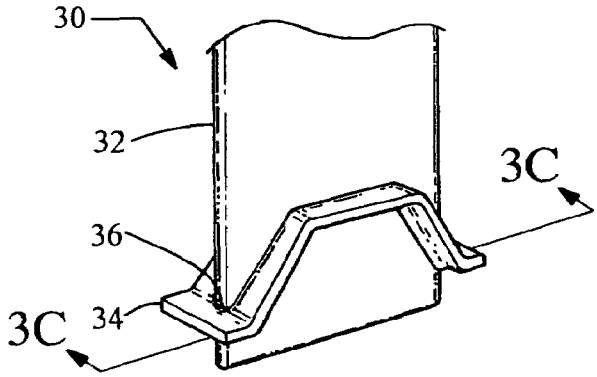
FIG. 3B depicts the header of FIG. 3A with one of the flat tubes in accordance with the invention.
Figure 3C:
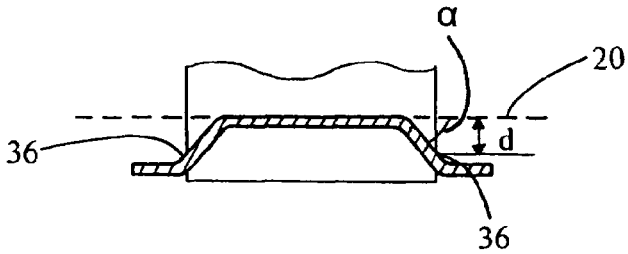
FIG. 3C is a view of the header along the line 3C-3C of FIG. 3B.

Referring now to FIG. 3A, there is shown a heat exchanger 30 with flat tubes (now identified as 32), cooling fins 5 positioned between the tubes 32, and a header 34 in accordance with the invention. Referring also to FIGS. 3B and 3C, the header 34 is configured to separate the externally induced service stress along the aforementioned "transition line of deformation" 20 from the highest stress concentrations occurring at the narrowest regions 36 of the juncture between the tube 32 and the header 34. This separation (d) effectively reduces the stress intensification at these regions 36 and distributes the stress more evenly over the entire tube-to-header joint, thereby prolonging the tube-to-header joint life. As shown in FIG. 3B, a header with a trapezoidal cross section can achieve such a separation.

Figure 4:
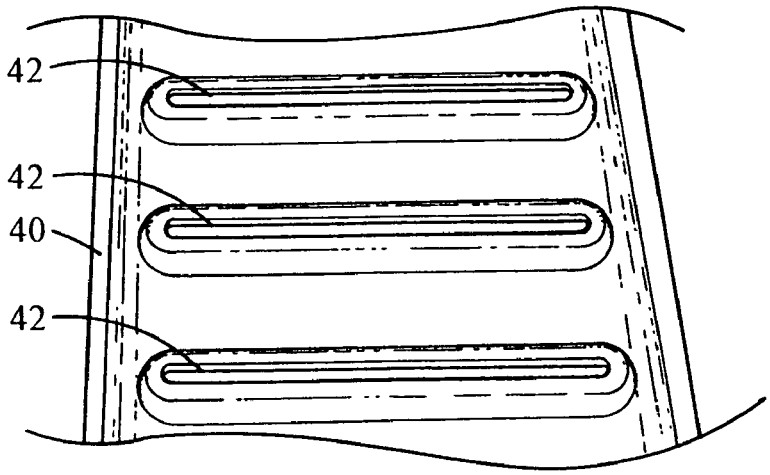
Fig. 4 Prior Art
FIG. 4 depicts a conventional flat header without tubes.
Figure 5:
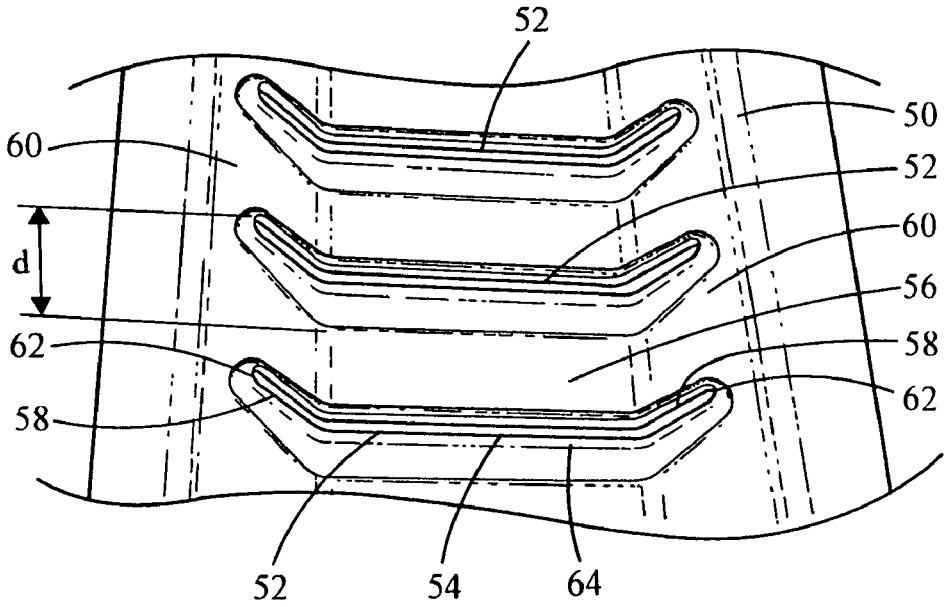
FIG. 5 depicts a trapezoidal header without tubes in accordance with the invention.
Figure 6:
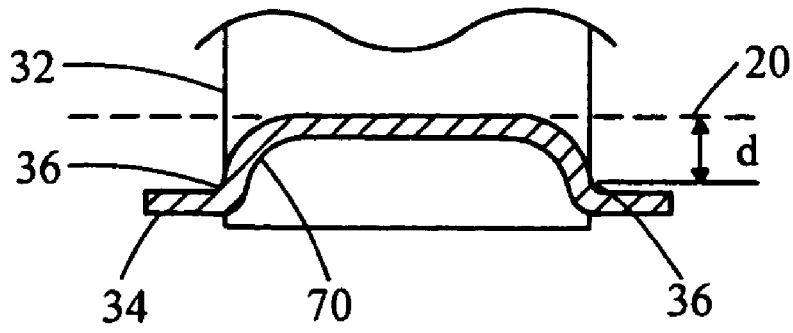
FIG. 6 is a cross-sectional view of an alternative header in accordance with the invention.
Figure 7:
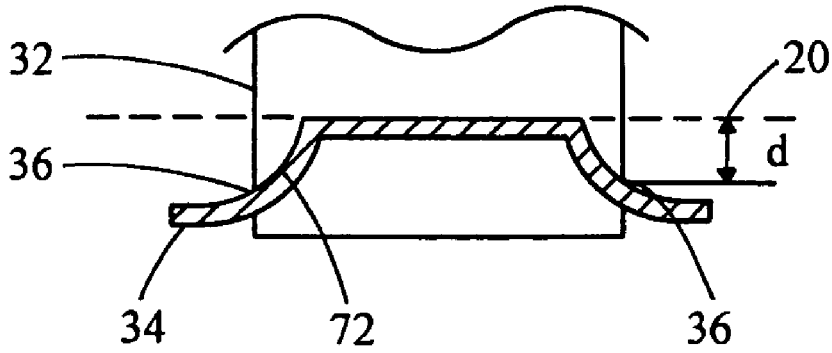
FIG. 7 is a cross-sectional view of yet another alternative header in accordance with the invention.

For the sake of comparison, a conventional flat header 40 shown in FIG. 4 was compared with that of a trapezoidal header 50 shown in FIG. 5 in thermal cycling tests. As can be seen in the comparison of FIGS. 4 and 5, the conventional header 40 has a series of essentially straight tube slots 42, while the trapezoidal header 50 has tube slots 52 that are not straight. Instead, each slot 52 has an elongate section 54 extending across a planar portion 56 of the header 50 and two end sections 58 that extend from the elongate section 54 into two stepped portions 60 of the header. The stepped portions 60 and hence the end sections 58 of the slots 52 rise at an angle, following a straight segment (or a curved segment as shown in FIGS. 6 and 7), from the plane of the planar portion 56, such that the terminal ends 62 of the end sections 58 are separated from the plane of the planar portion 56 by the separation distance (d). Depending upon the application of the header 50, the separation distance (d) may be the range from about 2 mm to about 20 mm. Surrounding each slot 52 is a raised region 64. These regions 64 provide added rigidity to the header 50 and a convenient platform along which the tubes are brazed to the header 50.

In certain embodiments, the header 50 is made from a metal such as aluminum or steel, or any other suitable material. Depending on the vehicle, the header 50 can be provided with six to two hundred slots. The slots 52 are spaced apart by about 4 mm to 15 mm, and each slot 52 is about 1 mm to 12 mm wide. The elongate section 54 of each slot is about 3 mm to 85 mm long and the end sections 58 are about 2.5 mm to 28 mm long. As mentioned above, each slot 52 is joined to a respective tube by a suitable method such as brazing, soldering, or mechanically assembling.

One skilled in the art would readily appreciate that the line of deformation 20 can be combined with the distance (d) and the length of the end section 58 of the slot 52 to define a right triangle having an angle (a) opposite the distance (d) as shown in FIG. 3C. The sine of an angle is equal to the length of the opposite side divided by the length of the hypotenuse. Therefore, the sine of the angle (a) is the distance (d) divided by the length of the end section 58 as indicated by Equation (1).

$$\sin\alpha = \frac{(d)}{length_{end-section}} \qquad \text{Equation (1)}$$

Substituting the values for the length of the end section 58 and the values for (d) into Equation (1) and solving, yields an angle a of about 4.1 degrees to about 89.9 degrees.

An example of the results of the thermal cycling tests is shown below in Table 1. In these tests, the headers were subjected to a cyclic thermal loading with a high-low temperature differential of about 130° C.

TABLE 1

| | Crack Initiation | Crack Propagation | Radiator Failed |
|---|---|---|---|
| Flat Header | 110 Cycles | 119 cycles | 119 cycles (two samples) |
| Trapezoidal Header | 854 Cycles | No visible crack propagation | Tests for two samples were suspended after 1572 cycles |

In Table 1, crack initiation cycle is defined as the cycle count at which there is evidence of coolant at the tube/header joint. Crack propagation cycle is defined as the cycle count at which there are several drops of coolant leakage per cycle. And radiator failure cycle is defined as the cycle count at which the test is terminated because of significant amount of leakage of coolant from the heat exchanger. As can be seen in Table 1, crack initiation occurred in the flat header around 110 cycles, and crack propagation was seen around 119 cycles. Thus, the radiator with the flat header was considered to have failed at 119 cycles. This example used a sample size of two for each configuration.

As for the trapezoidal header, crack initiation was observed around 854 cycles. However, crack propagation was never observed; that is, the radiator did not fail during the test. The test for the trapezoidal header was eventually terminated at 1572 cycles. In view of the above, it is seen that radiators provided with trapezoidal headers have life spans that vastly exceed that of radiators with flat headers.

It is therefore intended that the foregoing detailed description be regarded as illustrative rather than limiting, and that it be understood that it is the following claims, including all equivalents, that are intended to define the spirit and scope of this invention. For example, as shown in FIGS. 6 and 7, the header 34 can be provided with convex segments 70 (FIG. 6) or concave segment 72 (FIG. 7) rather than the straight segments shown in FIG. 3C.

What is claimed is:

1. A header for a heat exchanger, comprising:

a substantially planar base portion extending laterally defining a width and longitudinally defining a length; and a pair of step portions, each step portion extending longitudinally along a respective side of the base portion and extending laterally at an angle between about 15 and 75 degrees as a straight segment from the plane of the base portion; wherein, the base portion forms at least part of an outer wall surrounding an interior volume in fluid communication with a plurality of tube ends, the header being provided with a plurality of substantially parallel slots spaced apart along the length of the header, each slot having an elongate section extending across the width of the base portion and end sections extending from the elongate section into the step portions of the header, each elongate section and each end section of each slot being engaged with a single tube such that the tube extends through the slot and the header structurally supports the respective tube in the heat exchanger.

2. The header of claim 1, wherein the end sections each have a terminal end spaced apart from the plane of the base portion, thereby defining a separation distance.

3. The header of claim 2, wherein the separation distance is from about 2 mm to about 20 mm.

4. The header of claim 1, wherein the spacing between adjacent slots is between about 4 mm to 15 mm.

5. The header of claim 1, wherein the elongate section of the slots each have a length of about 3 mm to 85 mm.

6. The header of claim 1, wherein the end sections each have a length of about 2.5 mm to 28 mm.

7. The header of claim 1, further comprising an equal plurality of substantially flat tubes, each tube being inserted into a respective slot.

8. The header of claim 7, wherein each tube is brazed, soldered, or mechanically assembled to the respective slot.

9. The header of claim 8, wherein the juncture between each tube and the elongate section of a respective slot defines a transition line of deformation.

10. The header of claim 9, wherein the transition line of deformation is spaced apart from the highest stress concentrations.

11. The header of claim 10, wherein the highest stress concentrations occur on the tube at or near the location of the juncture between the terminal ends of the end sections and the tube.

12. The header of claim 1 wherein the header is formed of a plate having a substantially constant thickness.

13. The header of claim 1 wherein the thickness of the base portion is equal to the thickness of the step portions.

14. The header of claim 1 wherein the base portion is of constant thickness and the step portions are of constant thickness, other than portions defining the slots.

* * * * *